United States Patent [19]

Nicholson

[11] 4,282,502

[45] * Aug. 4, 1981

[54] ELECTROMAGNETIC POSITIONER

[75] Inventor: Robert D. Nicholson, Birmingham, Mich.

[73] Assignee: Koehring Company, Milwaukee, Wis.

[ * ] Notice: The portion of the term of this patent subsequent to Nov. 4, 1997, has been disclaimed.

[21] Appl. No.: 875,303

[22] Filed: Feb. 6, 1978

[51] Int. Cl.[3] ..... H01F 5/00; H01F 7/08

[52] U.S. Cl. ..... 335/266; 335/229

[58] Field of Search ..... 335/229, 230, 231, 234, 335/266, 269

[56] References Cited

U.S. PATENT DOCUMENTS

| | | | |
|---|---|---|---|
| 2,794,092 | 5/1957 | Bengtsson | 335/266 X |
| 2,853,090 | 9/1958 | Hanna et al. | 335/266 X |
| 2,939,055 | 5/1960 | Gebhart | 335/266 |
| 3,058,038 | 10/1962 | Stedman | 335/229 |
| 3,777,784 | 12/1973 | Nicholson | 137/625.62 |

*Primary Examiner*—Fred L. Braun

*Attorney, Agent, or Firm*—Whittemore, Hulbert & Belknap

[57] ABSTRACT

An electromagnetic positioner for positioning the drive arm of an electrohydraulic servo valve or the like, comprising a mounting plate, a flexure tube secured to the mounting plate, a drive arm secured to the flexure tube, a top plate secured in parallel spaced apart relation to the mounting plate having a central opening therethrough, permanent magnets extending between the mounting plate and too plate, pole pieces secured to the mounting plate and extending toward the top plate on opposite sides of the flexure tube, control coils surrounding the pole pieces, and an armature positioned within the opening through the top plate in peripheral spaced relation thereto and secured to the flexure tube in spaced relation thereto and secured to the flexure tube in spaced relation to the pole pieces. Said electromagnetic positioner further including balance adjust structure, null adjust structure, and gain adjust structure.

10 Claims, 4 Drawing Figures

ELECTROMAGNETIC POSITIONER

BACKGROUND OF THE INVENTION

1. Field of the Invention

The invention relates to electromagnetic positioners and refers more specifically to an electromagnetic positioner for a drive arm of an electrohydraulic servo valve or the like constructed and arranged so that the work output for a given input signal is maximized within an envelope having a width and depth not larger than the valve body and a minimum height.

2. Description of the Prior Art

Electromagnetic positioners are often designed with the output work required for an input signal, that is, the movement of a drive arm in relation to a variable input signal, and a structure envelope being given.

The input to such devices is normally an analog signal which manifests itself as ampere turns as applied to control coils of the positioner. The work is then one-half of the ampere turns times the magnetic flux passing through the coils of the positioner if a linear relationship is assumed between flux and ampere turns.

The output of such devices is a displacement of a drive arm tip proportional to the number of applied ampere turns. The output work is one-half of the distance the drive arm tip is displaced times the force required to move the drive arm tip back to a null position, again assuming a linear relationship.

With a maximum output signal for a given input signal being attained and the width and depth of a valve body on which the electromagnetic positioner is used being determined, a minimum envelope may then be accomplished by minimizing the height of the envelope, that is, the height of the electromagnetic positioner structure, since the electromagnetic positioner structure is usually limited in width and depth dimensions by valve body dimensions.

The electromagnetic positioner of the invention has been particularly constructed and designed to provide a minimum envelope vertical height consistent with maximum output from a given input signal.

SUMMARY OF THE INVENTION

The electromagnetic positioner of the invention includes a mounting plate, a flexure tube secured to the mounting plate centrally thereof and extending perpendicularly thereto, a drive arm secured to the flexure tube for movement therewith, a top plate positioned in parallel spaced apart relation to the mounting plate, having an opening in the center thereof extending over the flexure tube, and permanent magnets extending between the mounting plate and top plate. A pair of pole pieces extending toward the top plate are secured to the mounting plate on opposite sides of the flexure tube. Control coils are mounted on the pole pieces, and an armature is secured to the flexure tube in the opening in the top plate in spaced relation to the pole pieces.

In operation, the armature is acted upon by the magnetic flux produced by the permanent magnets, and control coils to stress the flexure tube and produce controlled movement of the drive arm secured to the flexure tube in accordance with an electrical signal fed to the control coils.

The armature has a pivot point centered on the flexure tube and means are provided for adjusting the position of the armature about the pivot point to adjust the balance of the electromagnetic positioner.

Variable gain structure comprising screws passing through the mounting plate and axially adjustable toward and away from the top plate are provided to vary the gain of the electromagnetic positioner.

Null adjust structure is also provided in conjunction with the electromagnetic positioner of the invention. In one embodiment, the null adjust structure includes low rate springs and spring seats extending axially through the pole pieces between the mounting plate and top plate and adjustable conical members extending perpendicularly thereto in the plane of the mounting plate engaging the seats for varying the force applied by the springs on the armature at opposite ends thereof. In another embodiment of the null adjust structure wherein the vertical envelope is not as critical, the low rate springs are positioned to be directly movable toward and away from opposite sides of a hat member secured to the armature over the torsion tube by null adjust screws.

DESCRIPTION OF THE PREFERRED EMBODIMENT

Figure 2:
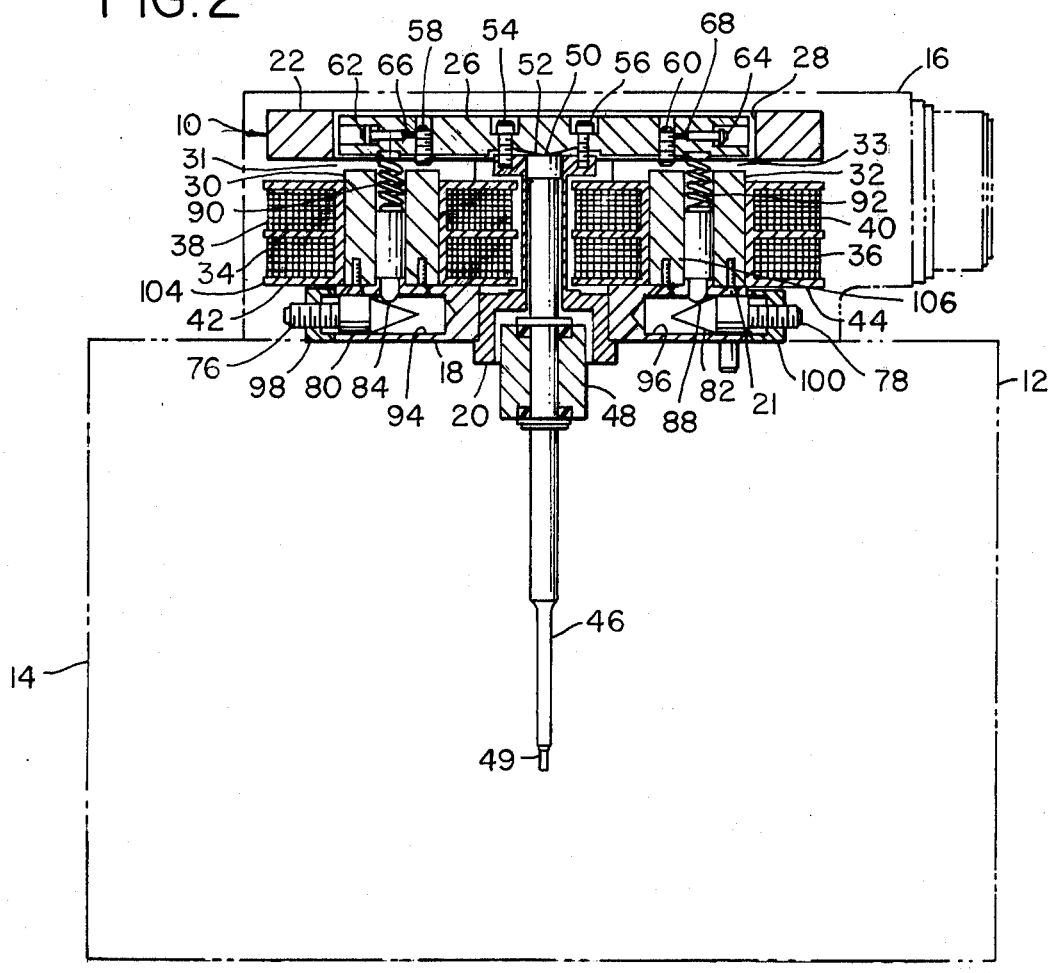
FIG. 2 is a section view of the electromagnetic positioner illustrated in FIG. 1, taken substantially on the line 2—2 in FIG. 1.

The electromagnetic positioner 10 of the invention, shown best in FIG. 2, is adapted to be used as part of an electrohydraulic servo valve 12, the valve body 14 and cover 16 of which are not part of the invention and are shown in phantom in FIG. 2. Such electrohydraulic servo valves are fully disclosed, for example, in U.S. Pat. No. 3,777,784.

Figure 3:
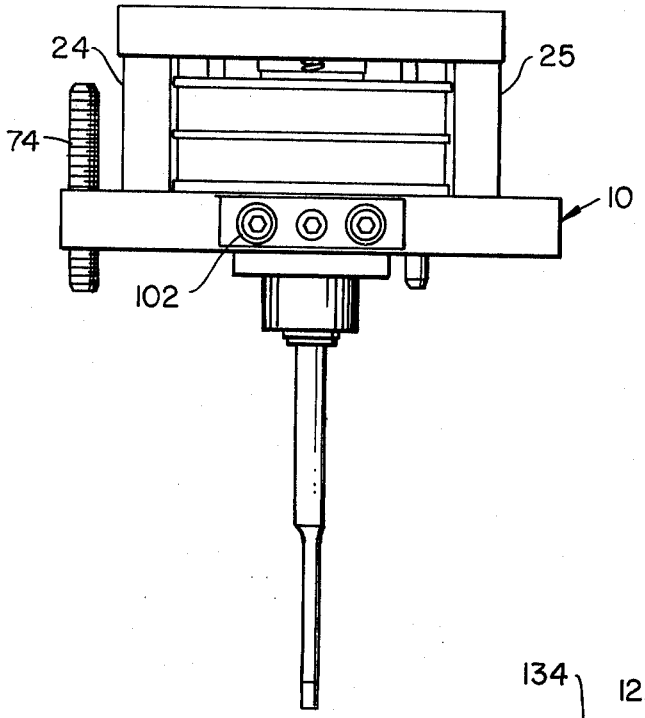
FIG. 3 is an end view of the electromagnetic positioner illustrated in FIG. 1, taken substantially in the direction of arrow 3 in FIG. 1.

The electromagnetic positioner 10 includes a mounting plate 18, a flexure tube 20 secured to the mounting plate 18, a top plate 22 supported in parallel spaced apart relation to the mounting plate 18 by permanent magnets 24 and 25 secured at opposite ends to mounting plate 18 and top plate 22 as shown best in FIG. 3, and armature 26 secured to the flexure tube 20 in the plane of top plate 22 within the opening 28 in the top plate 22.

Pole pieces 30 and 32 are secured to the mounting plate 18 on opposite sides of the flexure tube 20 by convenient means such as screws 21 and extend toward but stop short of the top plate 22, as shown best in FIG. 2. Control coils 34 and 36 and 38 and 40 are wound on coil frames 42 and 44 sleeved over the pole pieces 30 and 32. A coil 34, for example, wound around pole piece 30 in a clockwise direction is wired in series with a coil 36, for example, wound counterclockwise around pole piece 32 so that the same current passes through both coils. The other coils 38 and 40 are similarly wound and wired together. With such wiring, the coils appear externally as two identical coils. The two apparently identical coils can then be driven singly or together in series or parallel at will be selecting desired connections to the ends of the coils not wired together.

With such structure, the flux from the permanent magnets 24 and 25 will pass through a circuit including the top plate 22, the inactive air gaps 27 and 29 between the top plate 22 and armature 26, the armature 26, the active air gaps 31 and 33 between the ends of the armature 26 and pole pieces 30 and 32, and back to magnets 24 and 25 through the mounting plate. The flux from the permanent magnets 24 and 25 will always pass in the same direction through the pole pieces 30 and 32 with the magnets 24 and 25 similarly positioned.

The flux created by a variable electric input signal to the control coils 34, 36, 38 and 40, however, will vary in direction through pole pieces 30 and 32 in accordance with the energizing of the coils. If equal and opposing currents are applied to both coils, that is, the apparent single coils formed by coils 34 and 36 and by coils 38 and 40 simultaneously, the magnetic effects of both are cancelled. However, if current is greater in one apparent coil than in the other, the effect will be the same as applying only the difference in current to the one coil. Differential input control may thus be accomplished with the coil structure illustrated.

When current is applied to one apparent coil, a control flux is produced which is proportional to the applied current. The flux will go up through one pole, through an air gap between the one pole and armature, across the armature, through the air gap between the armature and the other pole, down the other pole and across the mounting plate to the first pole, completing a magnetic circuit. If the polarity of the current is reversed, then the direction the flux takes through the magnetic circuit is reversed. Since this control flux is going up through one air gap between the armature and one pole piece and down through the other, it will be in the same direction as the flux from the permanent magnet circuit at one pole piece and in the opposite direction at the other pole piece.

The result of the flux from the permanent magnets and control coils will be an increased pull on the end of the armature with the same flux pattern and a decreased pull on the end of the armature where the flux patterns are opposite, resulting in a net unbalanced force on the armature of the electromagnetic positioner. The flexure tube will provide the required movement of the drive arm 46 of the electromagnetic positioner in accordance with the unbalanced force on the armature.

The drive arm 46 as shown in FIG. 2 is adapted to be exposed in the usual manner to hydraulic fluid in the electrohydraulic servo valve 12 and includes the counterweight 48.

Flexure tube 20 serves as a centering spring which tends to keep air gaps 31 and 33 equal and also converts the unbalanced force on the armature to a proportional off-center displacement of the free end 49 of drive arm 46. The flexure tube 20 also serves to isolate the electromagnetic positioner 10 from hydraulic fluid and to resist the magnetic pull on the bottom of the armature 26.

To effect balancing of the electromagnetic positioner 10, a pivot point 50 is provided centrally of the armature which bears centrally on the end 52 of the flexure tube 20. Balance adjust screws 54 and 56 then extend through the armature 26 into the flexure tube 20 to pivot the armature 26 about the pivot point 50 to control the air gaps 31 and 33 as desired. The air gaps must be nearly equal in order to obtain the same gain in both directions of movement of the drive arm 46.

Overtravel limit screws 58 and 60 extend through the armature 26 as shown and may be adjusted axially with respect to the pole pieces 30 and 32 to prevent the armature 26 from coming so close to a pole piece that it might snap into the pole piece under magnetic attraction and damage the flexure tube. Setting of the screws 58 and 60 is provided by locking screws 62 and 64 acting against nylon pellets 66 and 68 engaged with the screws 58 and 60.

The gain of the electromagnetic positioner 10 may be varied by means of gain adjust screws 72 and 74 shown best in FIG. 3 extending through the mounting plate 18 which are axially adjustable toward and away from the top plate 22. The screws 72 and 74 which may be provided as desired on one or both sides of the mounting plate 18 vary the flux path for the flux created by the permanent magnets to bleed off part of the flux which would pass through the pole pieces 30 and 32 and thus vary the gain of the electromagnetic positioner.

Figure 1:
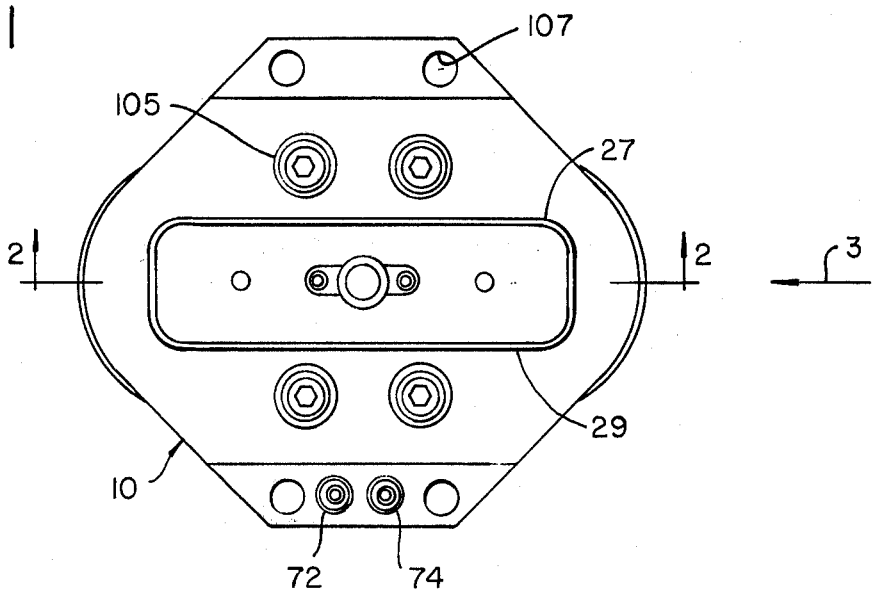
FIG. 1 is a top view of the electromagnetic positioner of the invention.

In the embodiment of the invention shown in FIGS. 1–3, a null bias adjustment is provided for the electromagnetic positioner by means of the null adjust screws 76 and 78 which act to move conical adjusting seats 80 and 82 with respect to the spring seats 84 and 88. Axial movement of the spring seats 84 and 88 varies the pressure which low rate springs 90 and 92 bring to bear on the armature 26. The force provided on armature 26 by the low rate springs 90 and 92 will require an input current to counteract and so produces a null offset or a null adjustment in the electromagnetic positioner 10.

As shown best in FIG. 2, the conical members 80 and 82 move in bores 94 and 96 in the mounting plate 18 under the influence of the null adjust screws 76 and 78 which are threaded through the caps 98 and 100 secured to the mounting plate 18 by conventional means such as bolts 102 shown in FIG. 3. The spring seats 84 and 88 extend through the axial openings 104 and 106 in the pole pieces 30 and 32 along with the springs 90 and 92.

The bolts 105 extend between the mounting plate 18 and top plate 22 of the electromagnetic positioner 10 and serve to hold the positioner 10 in assembly. Bolts, not shown, extend through opening 107 in mounting plate 18 to secure the electromagnetic positioner 10 to valve body 14 of electrohydraulic servo valve 12.

Figure 4:
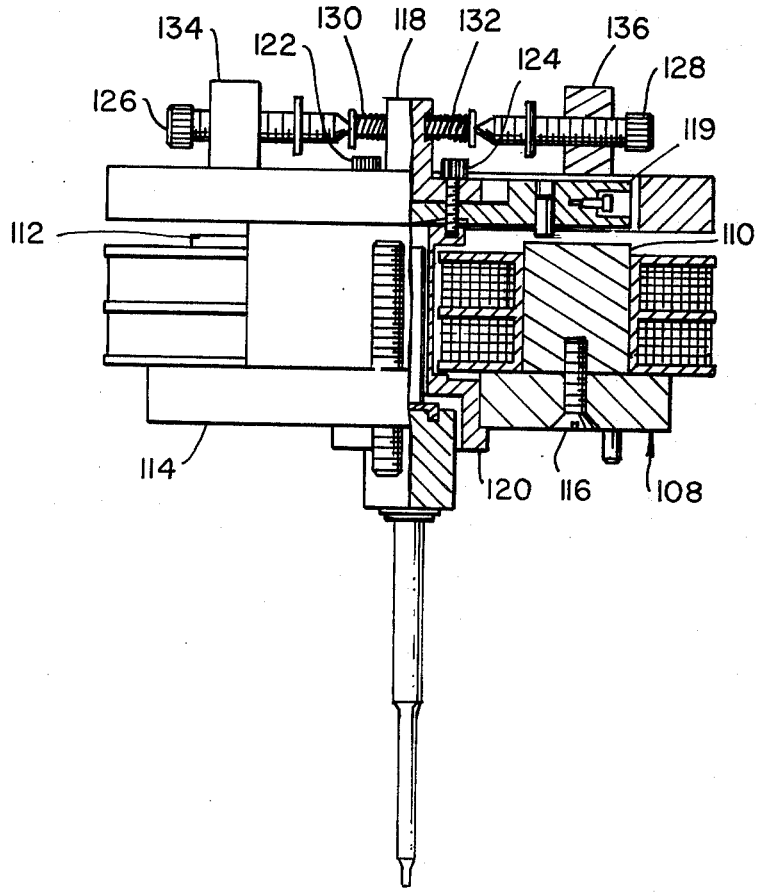
FIG. 4 is a partly broken away side elevation of a modification of the electromagnetic positioner shown in FIG. 1 showing modified null adjust structure.

In the modified electromagnetic positioner 108 shown in FIG. 4, wherein the vertical height of the envelope of the electromagnetic positioner is not quite so critical and/or the positioner is too small to permit placing the null adjust structure on the axis of the pole pieces, the pole pieces 110 and 112 are secured directly to the mounting plates by means of centrally located bolts such as bolt 114 and are solid cylinders. The null adjustment if required is then implemented by means of a cap member 118 secured to the armature 119 and flexure tube 120 by the balance adjust screws 122 and 124 in conjunction with the null adjust screws 126 and 128 axially aligned with the low rate springs 130 and 132 which are positioned between the ends of the screws 126 and 128 and the cap 118 as shown best in FIG. 4. Such null adjust structure as illustrated in FIG. 4 has the drawback of adding the height of the adjusting structure including the top plate ribs 134 and 136 through which the screws 126 and 128 are threaded to the envelope for the electromagnetic positioner 108.

While one embodiment of the present invention and a modification thereof have been considered in detail herein, it will be understood that other embodiments and modifications thereof are contemplated. It is the intention to include all embodiments and modifications of the invention as are defined by the appended claims within the scope of the invention.

What I claim as my invention is:

1. An electromagnetic positioner comprising a mounting plate having a top, a flexure tube secured at one end centrally to and extending perpendicularly from the top of the mounting plate, a drive arm supported partly within the flexure tube from the other end of the flexure tube for movement therewith, a top plate positioned in parallel spaced relation to the mounting plate having a central opening therethrough, permanent magnets extending between the top plate and the mounting plate, an armature positioned within the central opening in and in peripheral spaced relation to the top plate secured to the other end of the flexure tube for producing movement of the flexure tube in accordance with electromagnetic forces applied to the armature, a pair of pole pieces secured to the mounting plate on opposite sides of the flexure tube extending from the mounting plate toward the armature and terminated in spaced relation to the armature to provide an active air gap between each of the pole pieces and the armature whereby flux from the permanent magnets enters both pole pieces in the same direction across the air gaps, and control coils positioned around the pole pieces for receiving electrical signals therethrough to provide flux through the active air gaps to reinforce or oppose the flux from the permanent magnets in accordance with the electrical signal passed through the coils whereby the armature is caused to move to stress the flexure tube and provide movement of the drive arm in accordance with the signals received by the control coils.

2. Structure as set forth in claim 1, and further including balance means operably associated with the armature for setting the air gaps between the armature and the pole pieces.

3. Structure as set forth in claim 1, and further including means for mechanically biasing the armature to adjust the null position of the drive arm.

4. Structure as set forth in claim 1, and further including means for adjusting the gain of the electromagnetic positioner comprising means for bleeding flux between the mounting plate and top plate.

5. An electromagnetic positioner for use in positioning the drive arm of an electrohydraulic servo valve or the like, comprising a mounting plate, a flexure tube one end of which is secured to the mounting plate centrally thereof, the other end of which extends perpendicularly to the mounting plate, an electromagnetic servo valve drive arm positioned partly within the flexure tube one end of which is secured to the other end of the flexure tube whereby the drive arm is moved in accordance with the movement of the other end of the flexure tube, a pair of cylindrical pole pieces one end of each of which is secured to the mounting plate in spaced relation to and on opposite sides of the flexure tube, electromagnetic control coils sleeved over the pole pieces, permanent magnets mounted at one end to the mounting plate and extending perpendicularly thereto in the direction of the pole pieces and flexure tube, a top plate secured to the other ends of the permanent magnets in parallel spaced relation to the mounting plate having a central opening therethrough extending over the other end of the flexure tube and the pole pieces, an armature positioned within the opening in and parallel to the top plate in peripheral spaced relation thereto adjustably secured to the one end of the flexure tube in spaced relation to the ends of the pole pieces, balance adjust means operable between the armature and the flexure tube for adjusting the balance of the positioner, null adjust means operably associated with the armature for adjusting the null condition of the positioner, and gain adjust means operable between the mounting plate and top plate for adjusting the gain of the positioner.

6. Structure as set forth in claim 5, wherein four coils are provided in pairs on the two pole pieces with the coils in each pair of coils being wound in opposite directions around separate pole pieces and being connected in series with each other at one end whereby the coils may be operated singly, or together reinforcing each other, or in opposition, and in parallel or series.

7. Structure as set forth in claim 5, wherein the balance adjust means comprises a central pivot point between the armature and the one end of the flexure tube and balance adjust screws extend through the armature into the one end of the flexure tube for adjusting the relative pivotal position of the armature on the one end of the flexure tube.

8. Structure as set forth in claim 5, wherein the null adjust means comprises an axially extending cylindrical opening in each of the pole pieces, spring seats positioned within the cylindrical openings for movement axially thereof, cylindrical openings within the mounting plate extending beneath the pole pieces and in communication with the openings therein, conical members within the openings in the mounting plate adapted for movement into and out of the openings in the mounting plate in engagement with the spring seats for adjusting the position of the spring seats axially of the pole pieces, and low rate springs positioned partly within the cylindrical openings in the pole pieces and extending outwardly of the other end thereof into engagement with the armature at one end and in engagement with the spring seats at the other ends thereof.

9. Structure as set forth in claim 5, wherein the null adjust means comprises a cap member extending perpendicularly from the armature as an extension of the flexure tube and rigidly secured thereto, a pair of rigid ribs on the top plate extending across the opening therein over the opposite ends of the armature and a separate low rate spring and adjusting screw in series between each rib and the cap member.

10. Structure as set forth in claim 8, wherein the gain adjust means comprises at least one axially adjustable screw extending through the mounting plate toward the top plate.

* * * * *